US007665269B2

(12) United States Patent
Azar

(10) Patent No.: US 7,665,269 B2
(45) Date of Patent: Feb. 23, 2010

(54) INTERLOCKING BLOCK

(75) Inventor: Tony J. Azar, Windsor (CA)

(73) Assignee: Azar Mortarless Building Systems, Inc. (CA)

( * ) Notice: Subject to any disclaimer, the term of this patent is extended or adjusted under 35 U.S.C. 154(b) by 0 days.

(21) Appl. No.: 11/954,549

(22) Filed: Dec. 12, 2007

(65) Prior Publication Data

US 2008/0148676 A1 Jun. 26, 2008

Related U.S. Application Data

(62) Division of application No. 11/224,170, filed on Sep. 12, 2005, now abandoned.

(30) Foreign Application Priority Data

Sep. 14, 2004 (CA) ..... 2,481,534

(51) Int. Cl.
*E04B 2/08* (2006.01)

(52) U.S. Cl. ..... 52/592.1; 52/604

(58) Field of Classification Search ..... 52/591.1, 52/591.3, 592.1, 592.3, 592.5, 592.6, 604–606; D25/113, 114; 405/284–286; 446/124
See application file for complete search history.

(56) References Cited

U.S. PATENT DOCUMENTS

| | | | | | |
|---|---|---|---|---|---|
| 511,249 | A | * | 12/1893 | Oudin | 52/606 |
| 833,721 | A | * | 10/1906 | Kupper | 52/503 |
| 926,767 | A | * | 7/1909 | Rehaut | 52/592.5 |
| 1,171,191 | A | | 2/1916 | Gronert et al. | |
| 1,406,354 | A | * | 2/1922 | Mathias | 52/606 |
| 2,126,011 | A | | 8/1938 | Henry | |
| 2,684,589 | A | * | 7/1954 | Arnold | 52/591.2 |
| 2,736,188 | A | | 2/1956 | Wilhelm | |
| 3,717,967 | A | * | 2/1973 | Wood | 52/259 |
| 3,855,752 | A | * | 12/1974 | Aylon | 52/605 |
| 3,968,615 | A | * | 7/1976 | Ivany | 52/439 |
| 4,075,808 | A | | 2/1978 | Pearlman | |
| D314,240 | S | * | 1/1991 | Scheiwiller | D25/113 |
| D365,404 | S | * | 12/1995 | Landry, Jr. | D25/115 |
| 5,715,635 | A | * | 2/1998 | Sherwood | 52/286 |
| 5,960,604 | A | | 10/1999 | Blanton | |
| 6,082,067 | A | | 7/2000 | Bott | |

(Continued)

FOREIGN PATENT DOCUMENTS

GB 2 197 358 5/1988

*Primary Examiner*—Robert J Canfield
*Assistant Examiner*—Christine T Cajilig
(74) *Attorney, Agent, or Firm*—Gerald E. Hespos; Anthony J. Casella

(57) ABSTRACT

A construction block includes rectangular front and rear panels and at least one web connecting the front and rear panels. Each of the front and rear panels has top, bottom, and right and left edge surfaces. At least one web having top and bottom surfaces co-extensive with the top and bottom of the front and rear panels is provided to define top and bottom surfaces of the block. The top surface of the block has a shallow rectangular ridge along its length, flanked by outer support surfaces. The lower surface of the block has a shallow rectangular channel along its length, flanked by flat outer feet corresponding to the outer support surfaces. The right and left edge surfaces of the front and rear panels are profiled to interfit with one another.

6 Claims, 20 Drawing Sheets

U.S. PATENT DOCUMENTS 6,226,951 B1 5/2001 Azar
6,591,569 B2 7/2003 Azar
6,735,913 B2 * 5/2004 Sanders et al. ..... 52/284
2002/0152710 A1 10/2002 Guibert et al.

* cited by examiner

INTERLOCKING BLOCK

This application is a divisional of application Ser. No. 11/224,170 filed on Sep. 12, 2005, now abandoned.

BACKGROUND OF THE INVENTION

1. Field of the Invention

The present invention relates to the field of construction elements. In particular, the present invention provides an improved concrete block useful for constructing above and below grade walls.

2. Description of the Related Art

In applicant's issued U.S. Pat. No. 6,226,951, a robust concrete block is disclosed. Each block has a front panel, a rear panel, and webs that connect the front and rear. The blocks are notched at their ends to interfit and have complementary top and bottom profiles that also interfit. The blocks can be assembled without the aid of mortar, using specially designed corner blocks, into wall structures that can then be filled with concrete, resulting in a substantially monolithic concrete wall structure. The present invention is an improvement on the blocks described in U.S. Pat. No. 6,226,951 in that it provides an improved design allowing for freer flow of concrete into the wall structure and improved interlocking ends that will effectively anchor the blocks in place after concrete is poured.

A modified interlocking end structure for dry stack blocks is shown in applicant's U.S. Pat. No. 6,591,569. In that patent, the blocks are provided with substantially Z shaped ends, to facilitate close end to end alignment of the blocks. Corner blocks with complementary Z shaped portions near the ends of their side panels are provided. The blocks of U.S. Pat. No. 6,591,569 fit together extremely well due to the interlocking of the Z shaped ends. However, the ends tend to be more fragile than is desirable, because the end wall is diagonal. The present invention overcomes this drawback, and provides a block with the effective interlock shown in U.S. Pat. No. 6,591,569, but without the end wall weakness. Moreover, the corner blocks of the present invention present flatter surfaces, and therefore they stack more effectively for shipping.

SUMMARY OF THE INVENTION

In a broad aspect, then, the present invention relates to a construction block for use in constructing walls, said block including a front panel, a rear panel, and at least one web connecting said front and rear panels, each of said front and rear panels being rectangular and having a top edge surface, a bottom edge surface, and right and left edge surfaces, said at least one web having top and bottom surfaces co-extensive with the top and bottom surfaces of said front and rear panels thereby to define a top surface of said block, and a bottom surface of said rock, said top surface of said block being provided with a shallow rectangular ridge along its length, flanked by longitudinally extending outer support surfaces, the lower surface of said block having a shallow rectangular channel formed therein along its length, flanked by longitudinally extending flat outer foot portions corresponding in width to said outer support surfaces; the right and left edge surfaces of said front and rear panels being profiled to interfit with one another, whereby the right front edge surface and the left rear edge surface each have a first profile, and the left front edge surface and the right rear edge surface each have a second profile, the first and second profiles being complementary to permit blocks to interfit end to end.

In another broad aspect, then, the present invention relates to a construction block for use in constructing walls, said block including a front panel, a rear panel, and two transverse end webs connecting said front and rear panels, each of said front and rear panels being rectangular and having a top edge surface, a bottom edge surface, and right and left edge surfaces, said webs having top and bottom surfaces co-extensive with the top and bottom surfaces of said front and rear panels thereby to define a top surface of said block, and a bottom surface of said rock, said top surface of said block being provided with a shallow rectangular ridge along its length, flanked by longitudinally extending outer support surfaces, the lower surface of said block having a shallow rectangular channel formed therein along its length, flanked by longitudinally extending flat outer foot portions corresponding in width to said outer support surfaces; the end webs being profiled to interfit with one another, whereby the right front edge surface of one end web and the left rear edge surface of the other end web each have a first profile, and the left front edge surface of said one end web and the right rear edge surface of said other web each have a second profile, the first and second profiles being complementary to permit blocks to interfit end to end.

The front and rear panels are preferably thickened toward the interior of said block at their right and left ends.

The first profile may be a concave vertical groove, and said second profile is a convex vertical ridge.

The concave vertical groove is preferably formed on the inner corner of a said edge surface.

The convex vertical ridge is preferably formed on the inner corner of a said edge surface.

Two said webs may be provided, with a generally rectangular hollow core formed between them.

The upper surface of said webs may be provided with a channel therein. The channel in the upper surface of said web will be large enough to accommodate reinforcing materials.

DETAILED DESCRIPTION OF THE PREFERRED EMBODIMENTS

Figure 1:
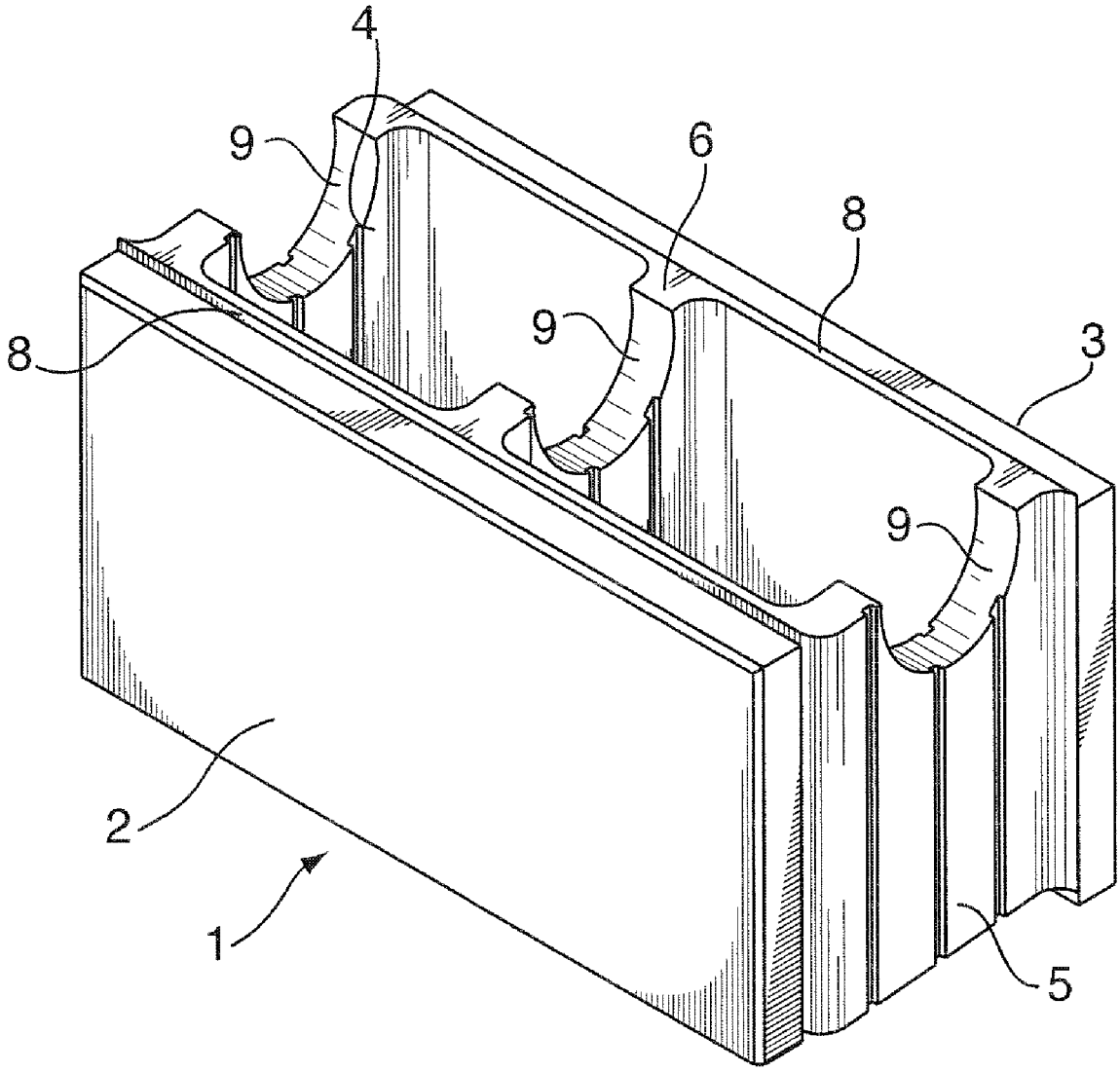
FIG. 1 is a perspective view of a stretcher block of the first embodiment of the present invention.
Figure 2:
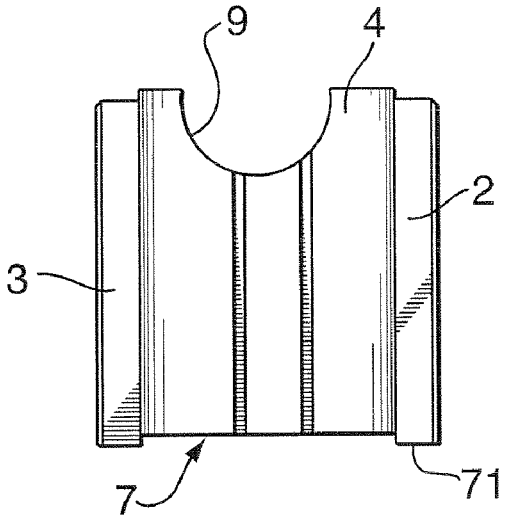
FIGS. 2 and 3 are end views of the block of FIG. 1.
Figure 3:
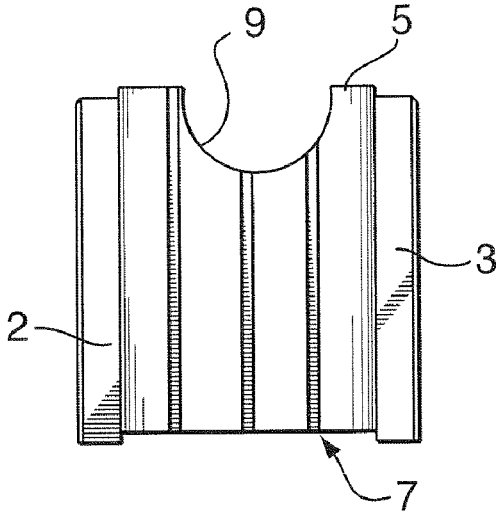
Figure 4:
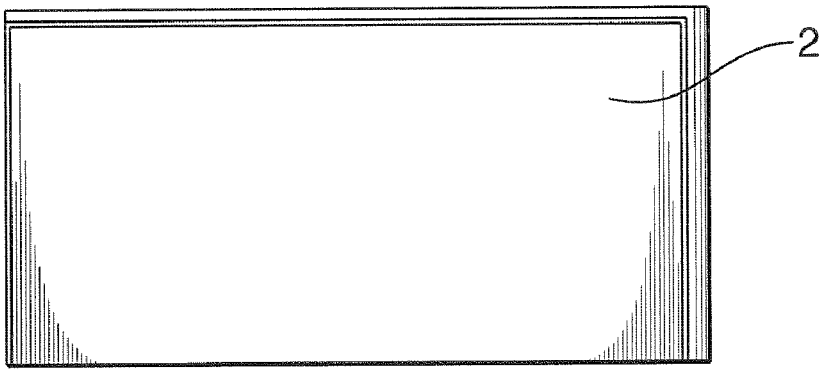
FIGS. 4 and 5 are front and rear views of the block of FIG. 1.
Figure 5:
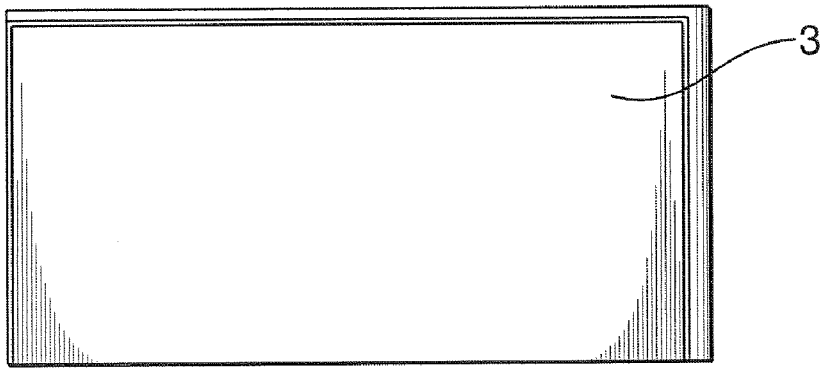

Referring now to FIGS. 1 to 42 in general, in which the first embodiment of the present invention is illustrated by providing views of all of the blocks that may be desirable in a construction project, and in particular to FIGS. 1 to 7, in which a stretcher block is shown, it will be seen that the basic block 1 of the present invention is generally rectangular. Rectangular front 2 and rear 3 walls are provided. The front and rear walls are connected by end webs 4, 5 and central web 6. As can best be seen in FIGS. 2 and 3, the end 4, 5 and central webs are generally rectangular and are offset vertically from the front 2 and rear 3 panels. This forms a shallow rectangular channel 7 at the lower extremity of the block, flanked by feet 71 (see FIG. 2).

Moreover, the inner edge 8 of the front 2 and rear 3 panels also extends upwardly to the same vertical level as the webs. This feature permits the blocks to interlock vertically when stacked in courses, and the upwardly extending edge 8 of the front and rear panels prevents concrete from oozing out from between courses of blocks when the finished wall structure is filled.

Generally semi-circular cut-outs 9 are formed in the top edges of each of the webs 4, 5, 6. The purpose of the cut-outs is three-fold. They provide a horizontal channel in which re-bar may be laid before concrete is poured. They provide channels that concrete may flow through when poured, to ensure that the entire wall structure is filled. And lastly, they provide channels the concrete can harden in, so that adjacent blocks in a course are rigidly locked together.

Figure 6:
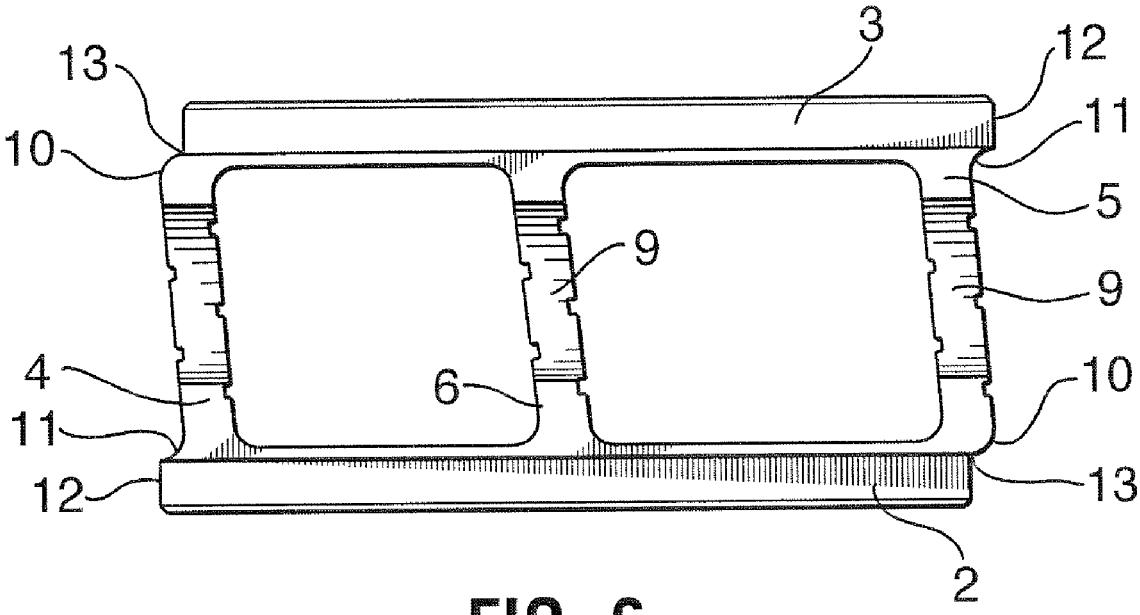
FIGS. 6 and 7 are top and bottom views of the block of FIG. 1.
Figure 7:
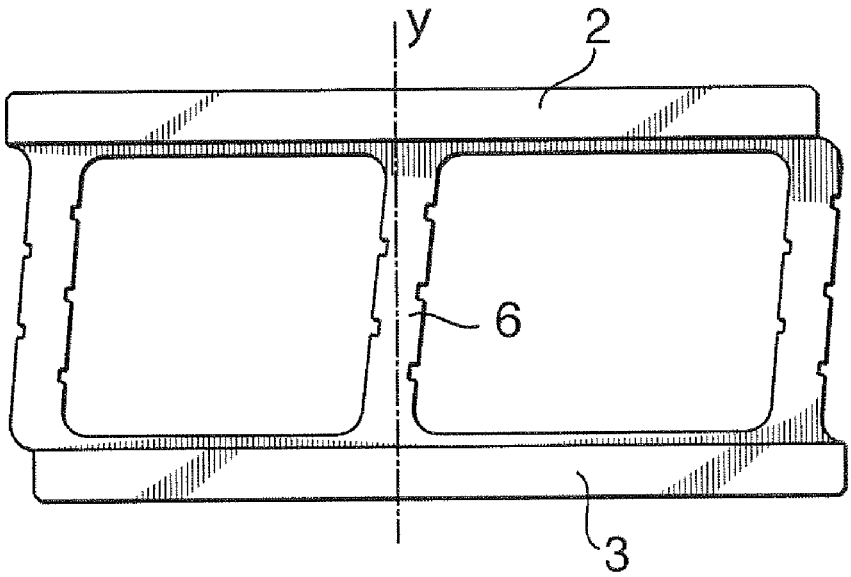
Figure 8:
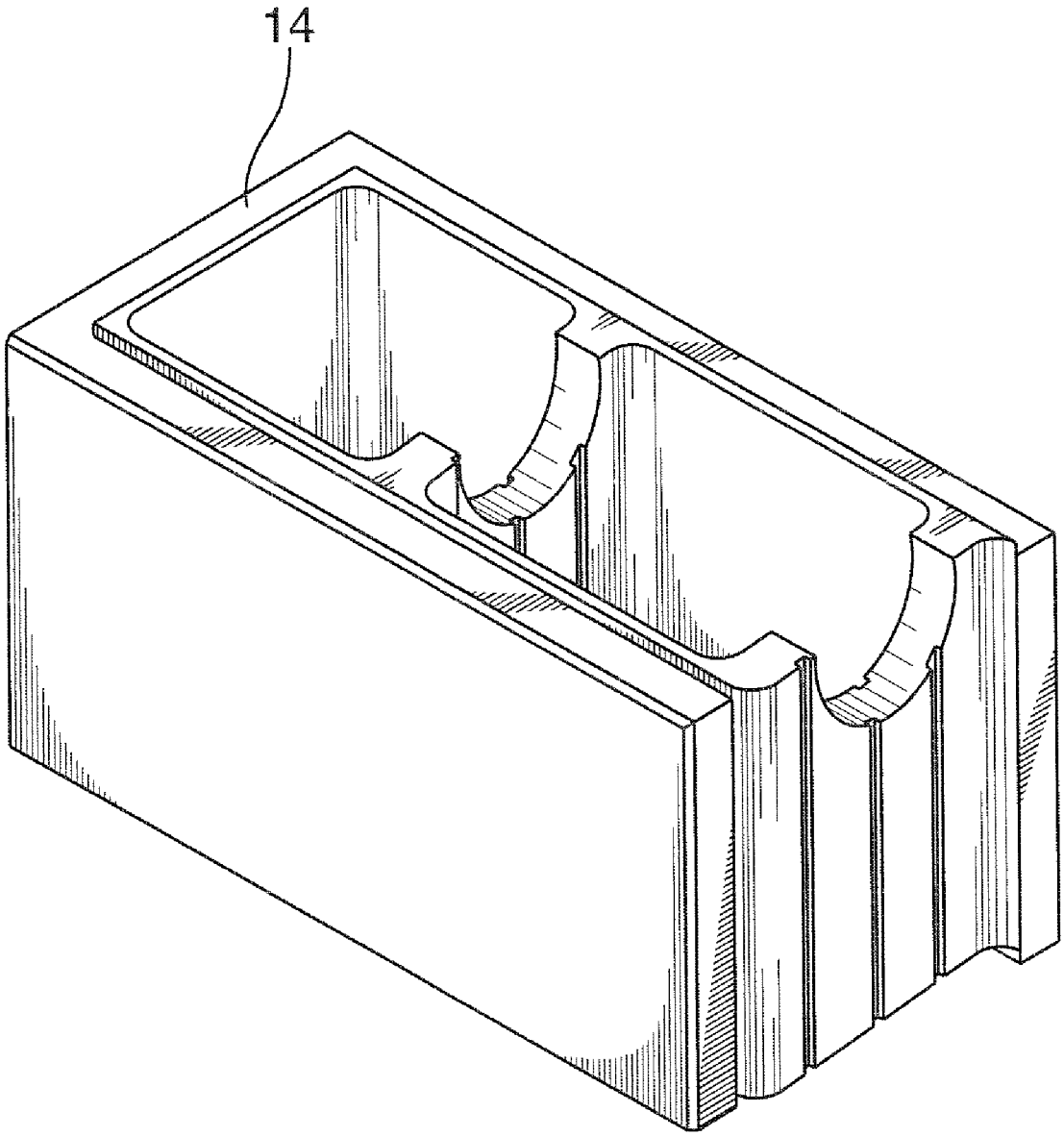
FIG. 8 is a perspective view of a sash block of the first embodiment of the present invention.
Figure 9:
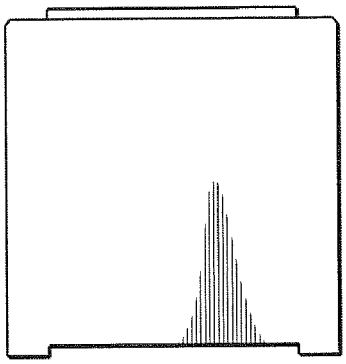
FIGS. 9 and 10 are end views of the block of FIG. 8.
Figure 10:
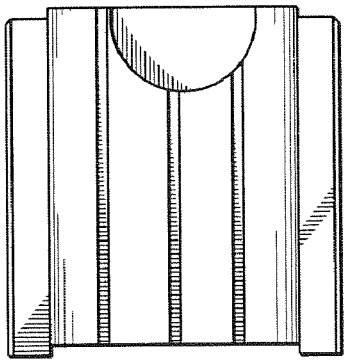
Figure 11:
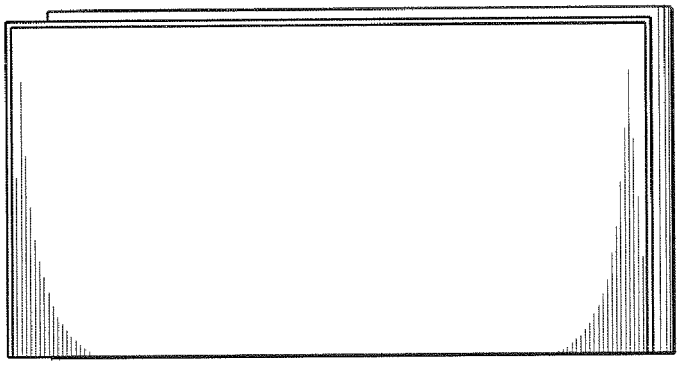
FIGS. 11 and 12 are front and rear views of the block of FIG. 8.
Figure 12:
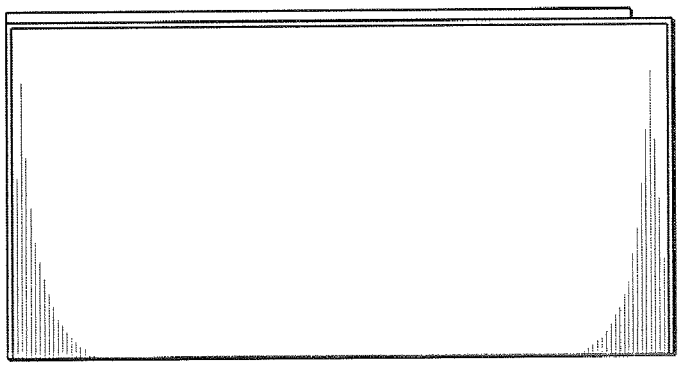
Figure 13:
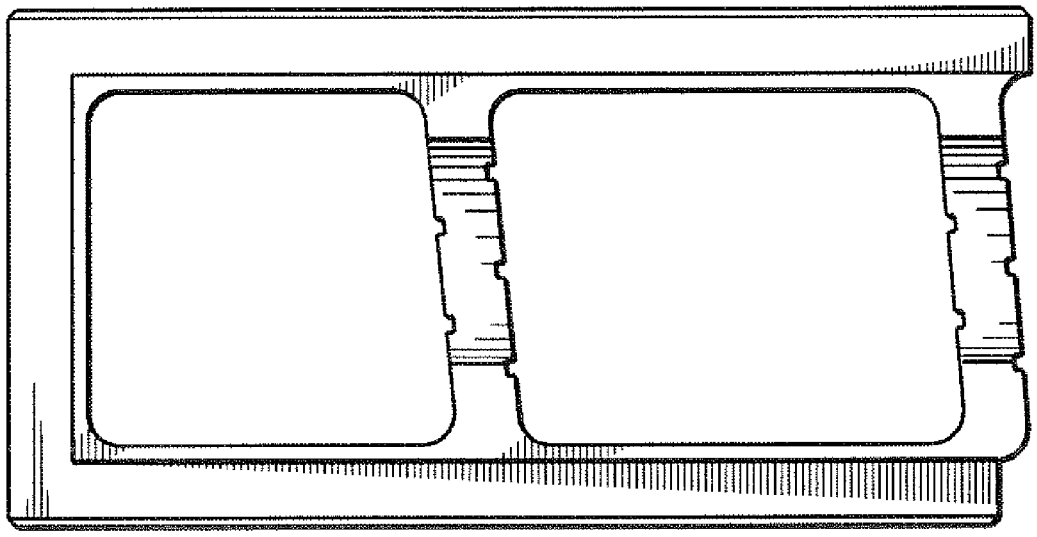
FIGS. 13 and 14 are top and bottom view of the block of FIG. 8.
Figure 14:
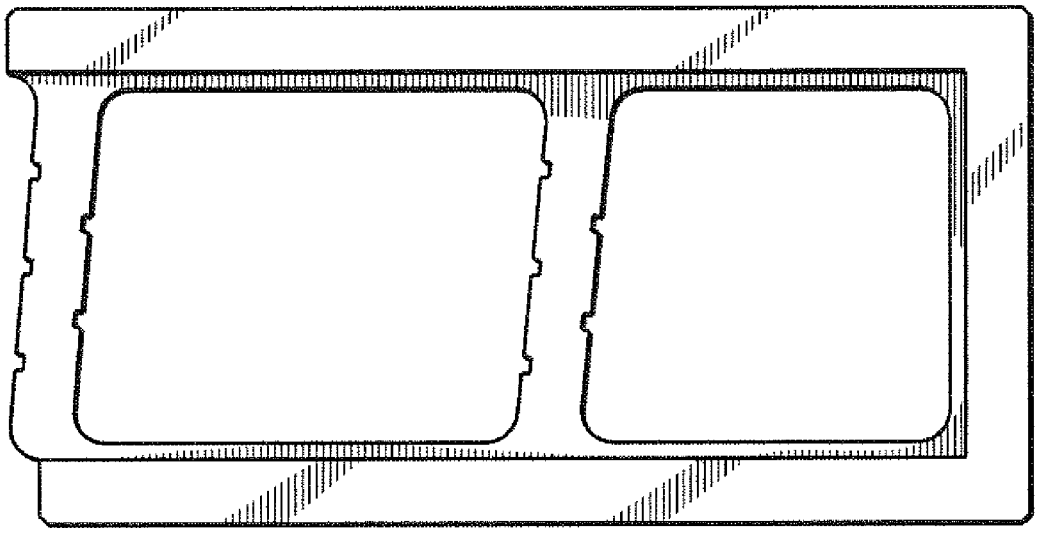
Figure 15:
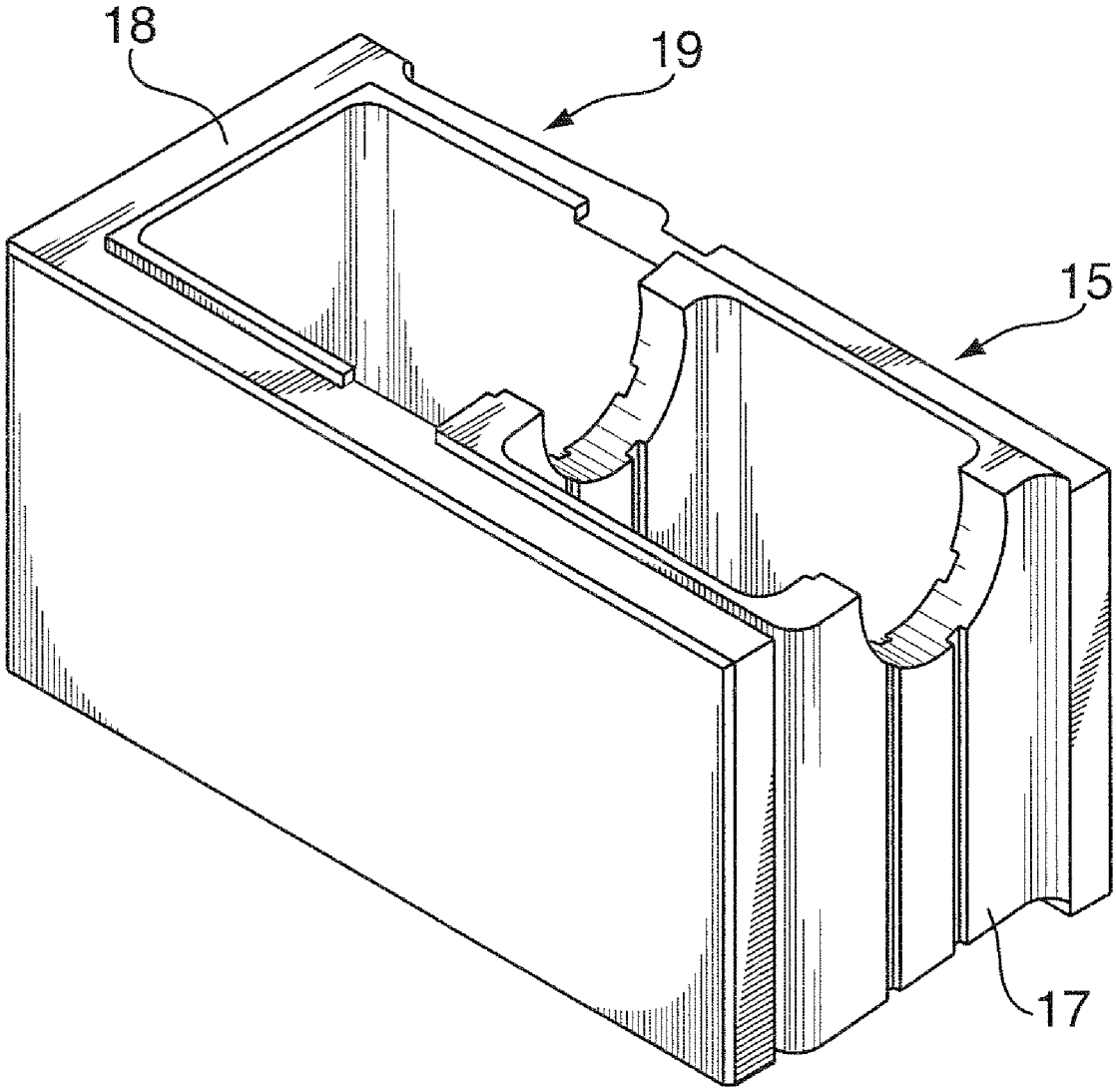
FIG. 15 is a perspective view of a right corner block of the first embodiment of the present invention.
Figure 16:
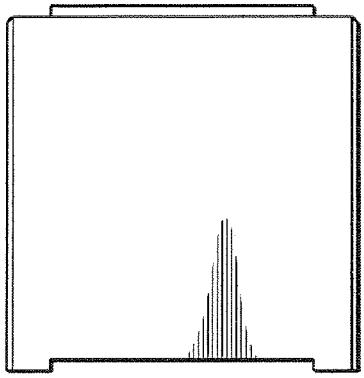
FIGS. 16 and 17 are end views of the block of FIG. 15.
Figure 17:
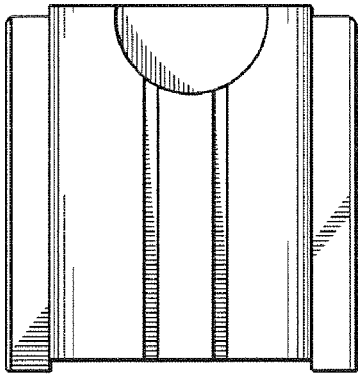
Figure 18:
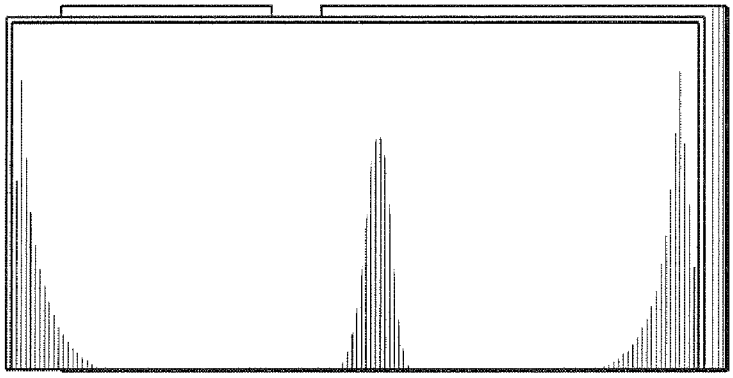
FIGS. 18 and 19 are front and rear views of the block of FIG. 15.
Figure 19:
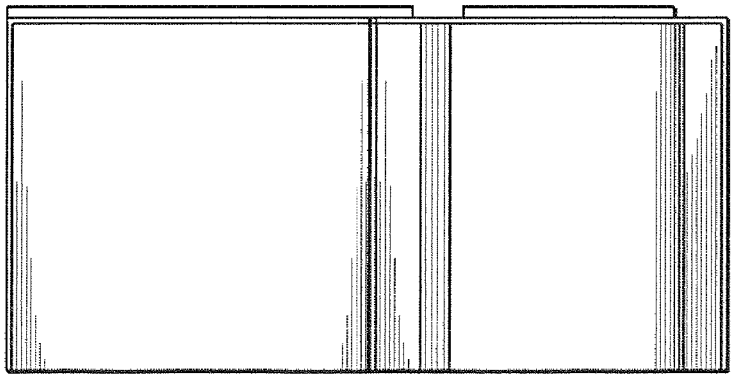
Figure 20:
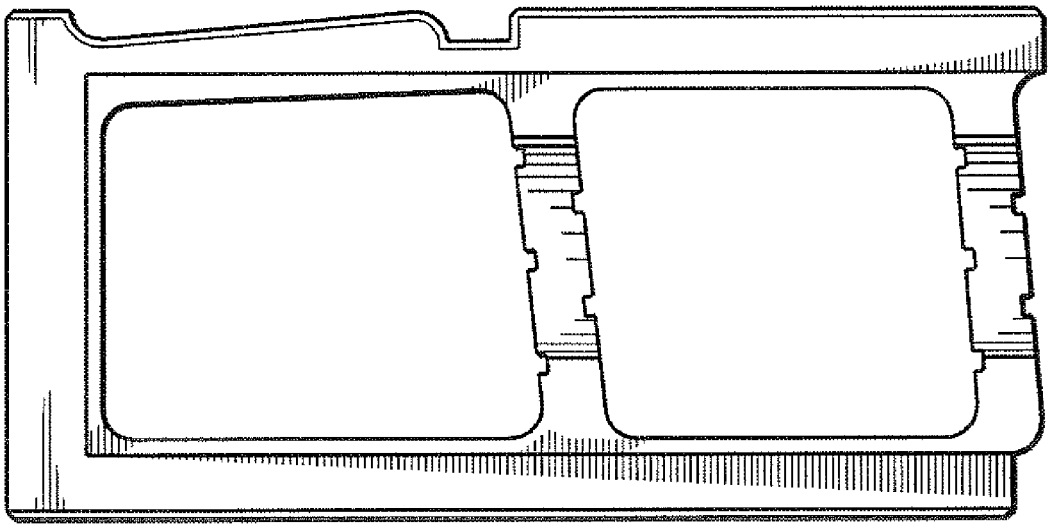
FIGS. 20 and 21 are top and bottom views of the block of FIG. 15.
Figure 21:
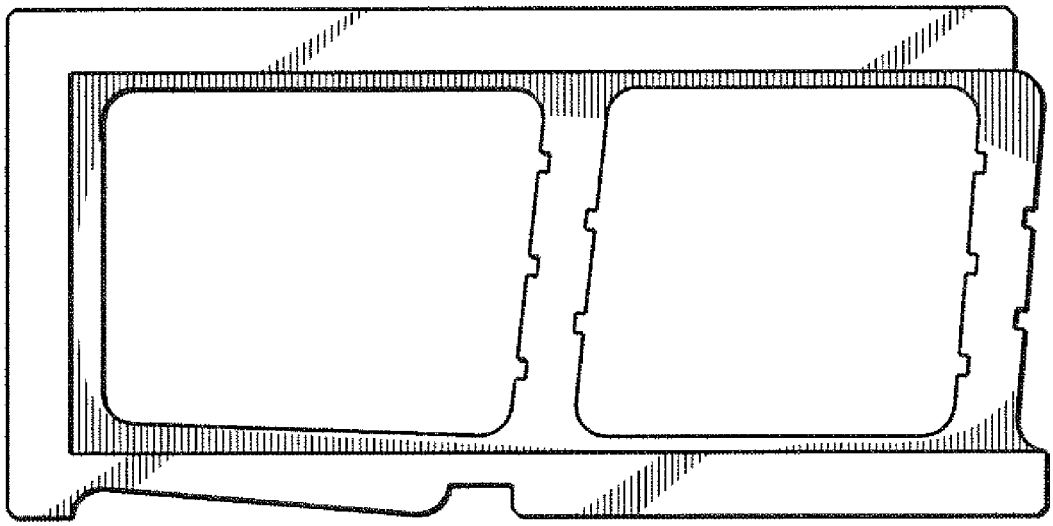
Figure 22:
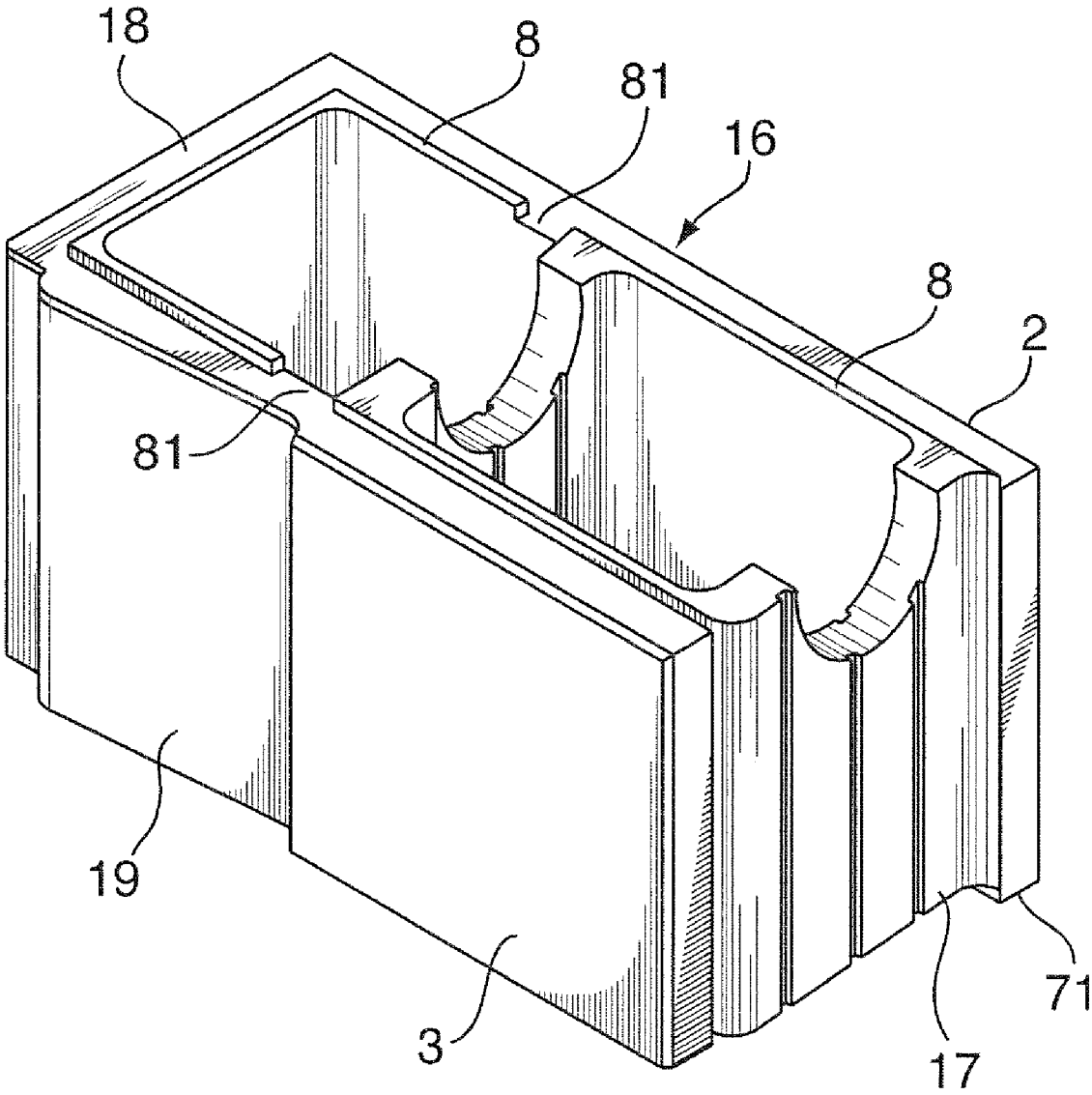
FIG. 22 is a perspective view of a left corner block of the first embodiment of the present invention.
Figure 23:
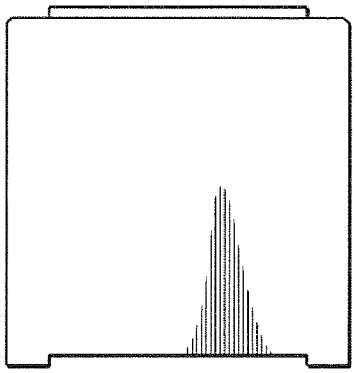
FIGS. 23 and 24 are end views of the block of FIG. 22.
Figure 24:
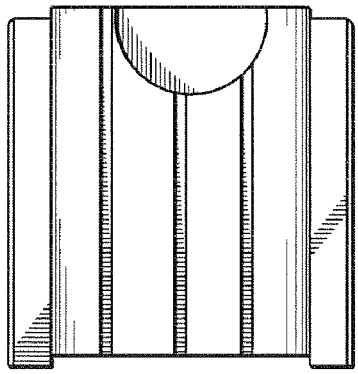
Figure 25:
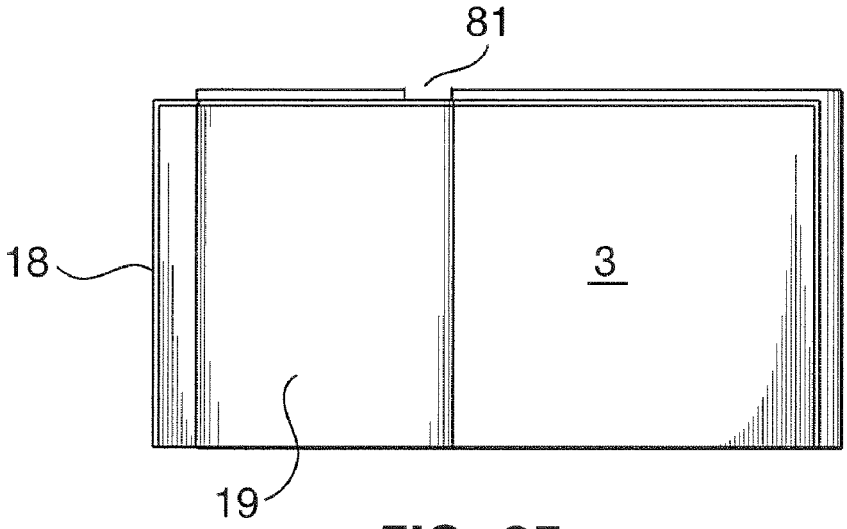
FIGS. 25 and 26 are front and rear views of the block of FIG. 22.
Figure 26:
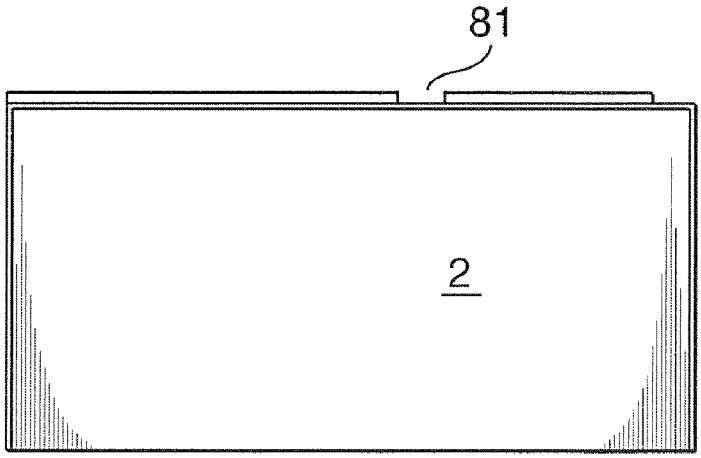
Figure 27:
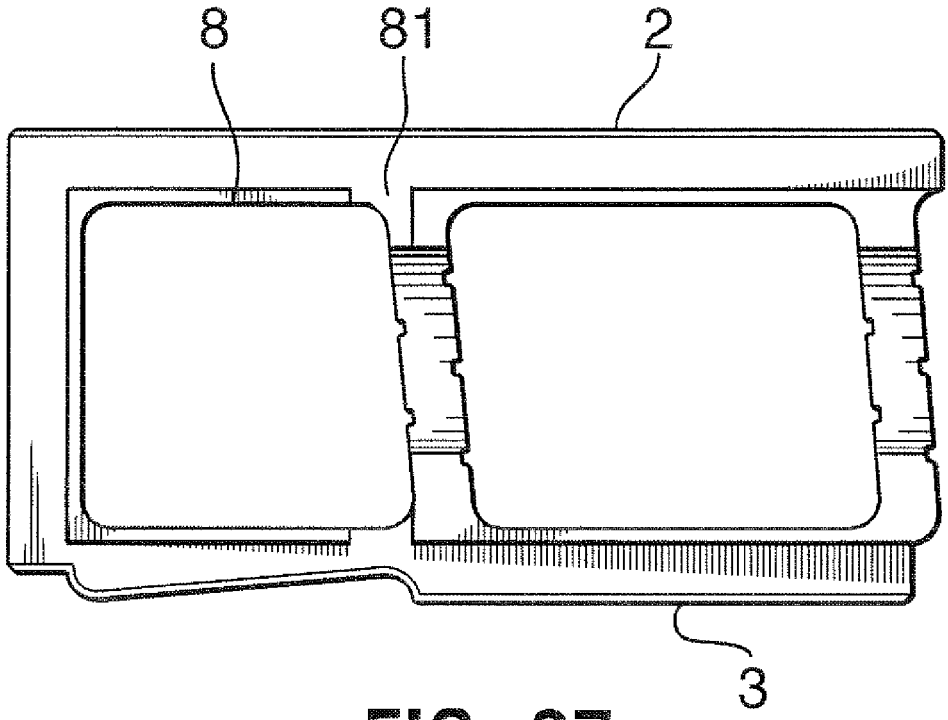
FIGS. 27 and 28 are top and bottom views of the block of FIG. 22.
Figure 28:
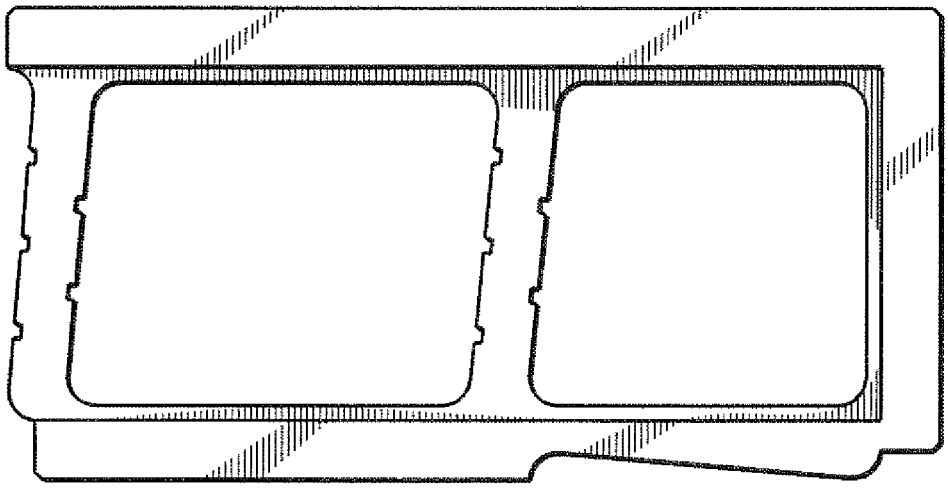
Figure 29:
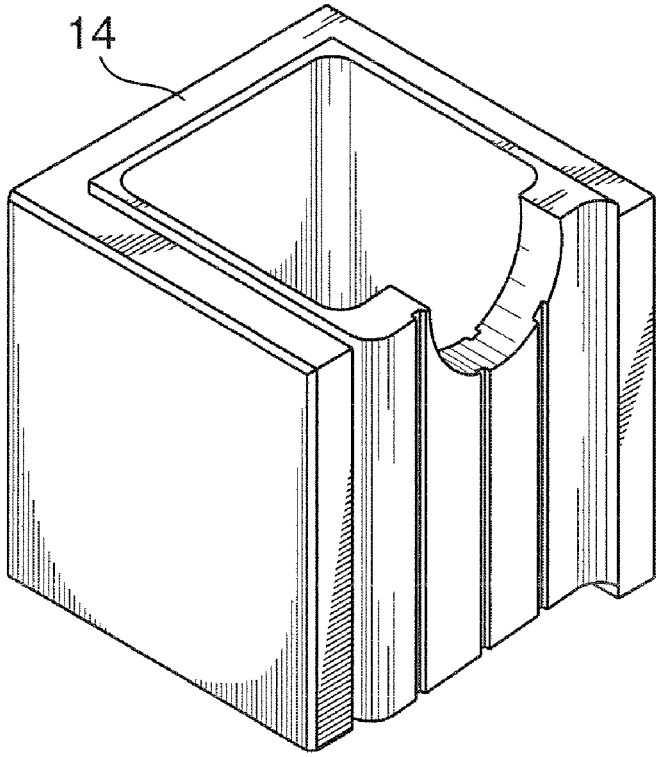
FIG. 29 is a perspective view of a half sash block of the first embodiment of the present invention.
Figure 30:
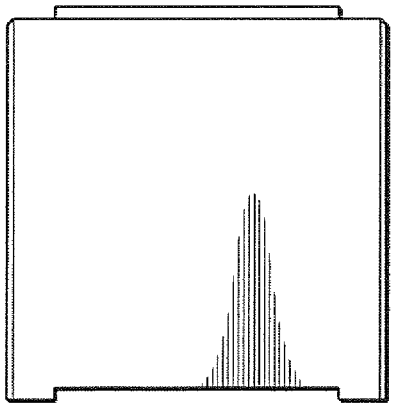
FIGS. 30 and 31 are end views of the block of FIG. 29.
Figure 31:
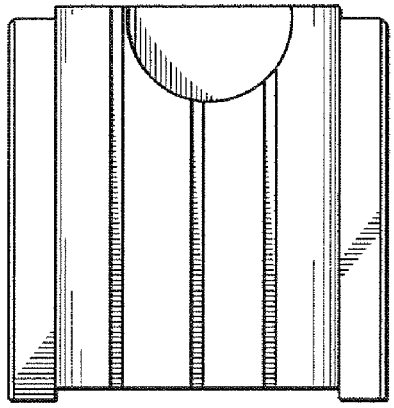
Figure 32:
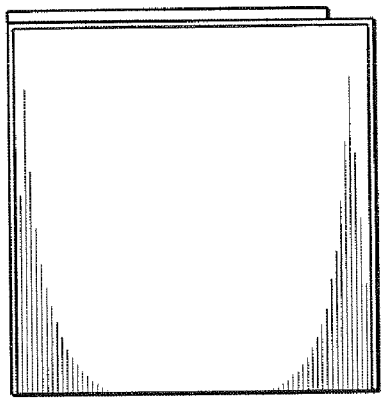
FIGS. 32 and 33 are front and rear views of the block of FIG. 29.
Figure 33:
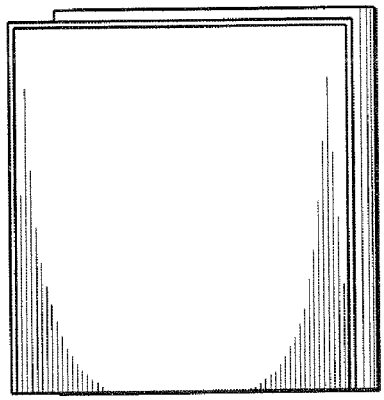
Figure 34:
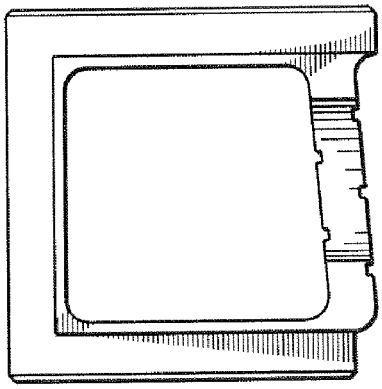
FIGS. 34 and 35 are top and bottom views of the block of FIG. 29.
Figure 35:
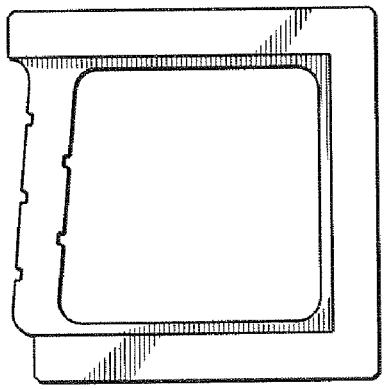
Figure 36:
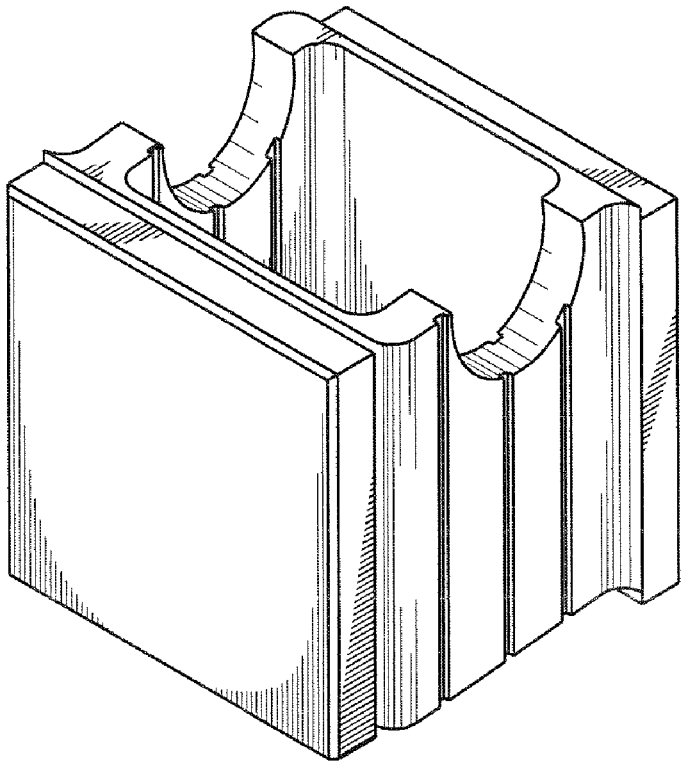
FIG. 36 is a perspective view of a half stretcher block of the first embodiment of the present invention.
Figure 37:
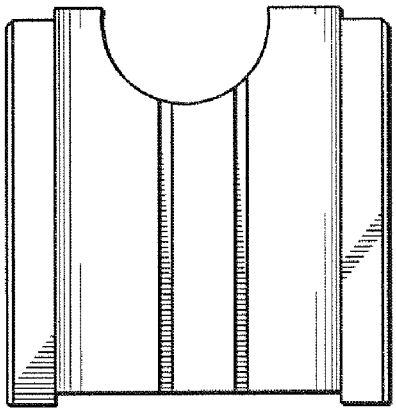
FIGS. 37 and 38 are end views of the block of FIG. 36.
Figure 38:
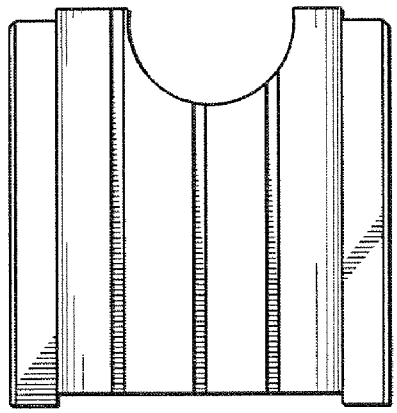
Figure 39:
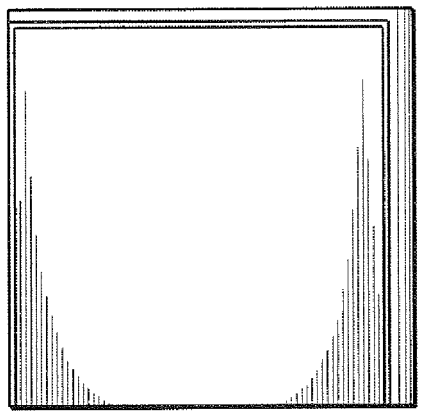
FIGS. 39 and 40 are front and rear views of the block of FIG. 36.
Figure 40:
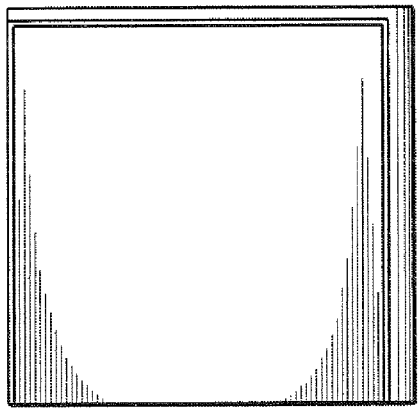
Figure 41:
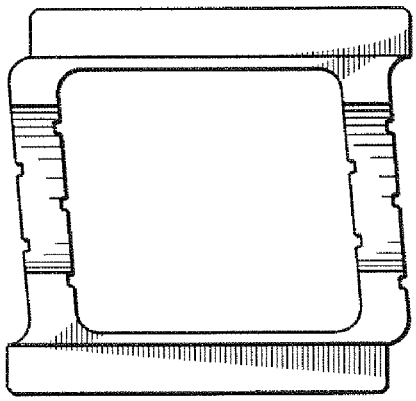
FIGS. 41 and 42 are top and bottom views of the block of FIG. 36.
Figure 42:
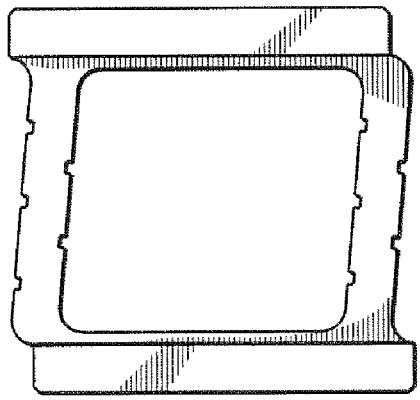

As can been seen most clearly in FIGS. 1, 6, and 7 the ends 4, 5, of the blocks 1 are profiled to interfit with one another. At each end the web 4, 5 is inclined slightly, by 5°-10° from perpendicular to the front and rear walls. Moreover, where the end webs 4, 5 meet the front and rear walls, they curve with either a convex 10 or concave 12 portion, such that when the blocks are laid end to end, the flange 12 created adjacent the concave curve 11 will rest into the groove 13 created adjacent the convex curve 10. A bead of caulking or construction adhesive may be applied to the grooves and flanges when courses of blocks are being laid, to assist in preventing water from penetrating between blocks.

It will be observed that because the webs 4, 5, 6 are only angled slightly (about 5°-10°) and are fairly thick (about 2-3 cm) a perpendicular line Y (see FIG. 7) from the front 2 to the rear 3 panel of the block will be contained entirely in the concrete of a web. Therefore, should the block encounter compressive forces on its exterior surfaces before being filled with concrete, these will be smoothly transmitted through the webs, rather than acting only as shearing forces on the webs.

The block fully illustrated in FIGS. 8-14 is known as a sash block 14. It is essentially a stretcher block with one flat end, designed to finish a wall edge, for instance at a wall or window opening. A half sash block is shown in FIGS. 29 to 35, and is used in combination with a sash block to complete alternate courses of blocks, to yield a flat wall end surface made up of vertically aligned flat surfaces 14 of sash and half-sash blocks.

A half stretcher block, similar to a stretcher block, but of half the length and therefore missing middle web 6 is shown in FIGS. 36 to 42.

Right 15 and left 16 corner blocks respectively are illustrated in FIGS. 15 to 21 and 22 to 28. Each corner block resembles a sash block in that it has one inclined end web 17 and a flat end 18 opposite. However, on the rear panel adjacent the flat end 18, is formed a channel 19 profiled to fit the end of a stretcher block. In the case of a right corner block, the channel is inclined inwardly toward the flat end 18, and in the case of a left corner block, the channel is inclined inwardly away from the flat end 18.

Directly above the channel 19 at the end of the corner blocks 15, 16, channels 81 are formed in the inner edge of the front and rear panels of the corner blocks. Channels 81 accommodate feet 71 formed by the bottom edge of the front and real walls 2, 3.

FIGS. 43 to 50 illustrate an alternate embodiment of the present invention which, although outwardly dissimilar, is fully compatible, and stackable with, the embodiment illustrated in FIGS. 1 to 42.

Figure 43:
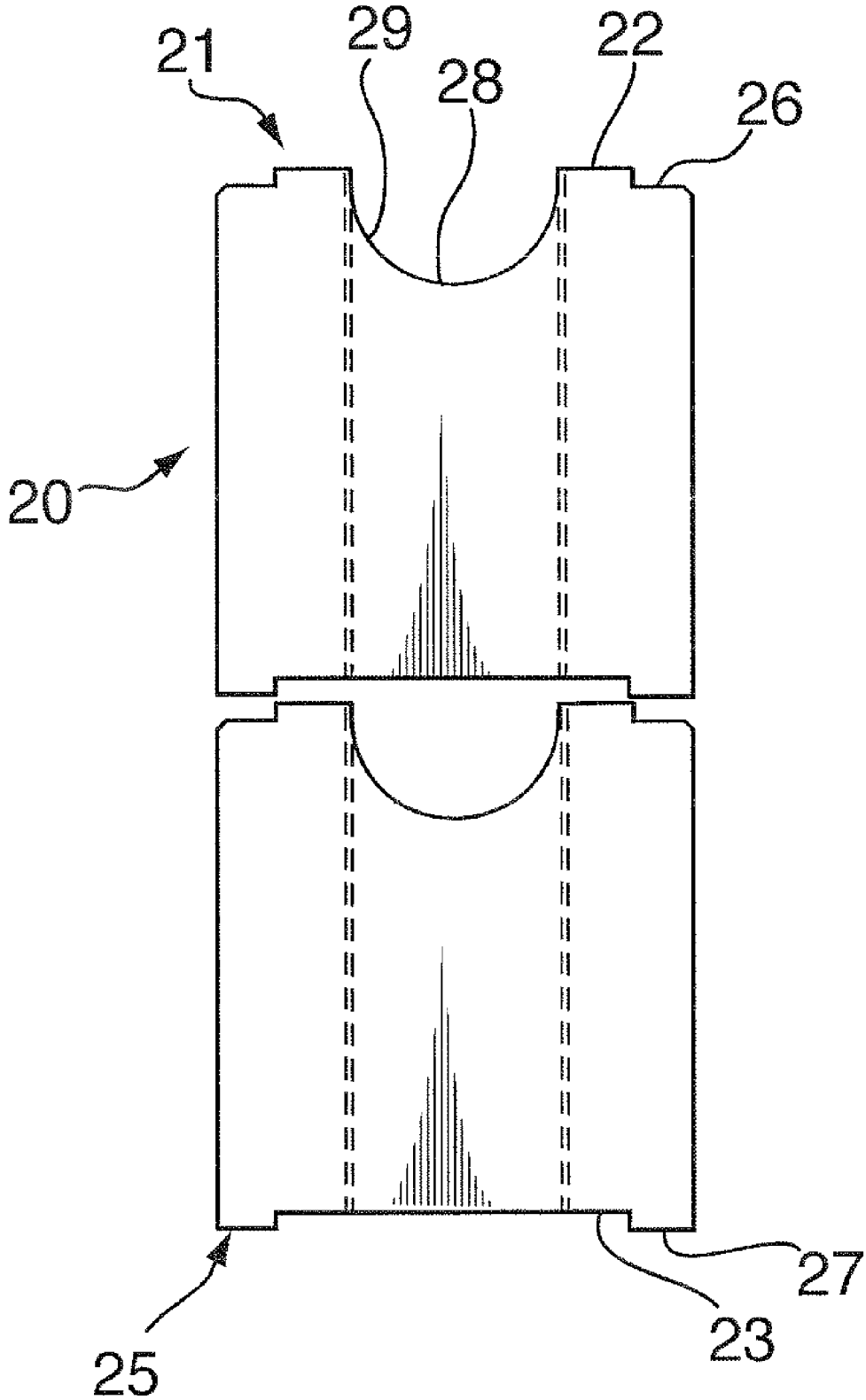
FIG. 43 is a generic end view of a block of the second embodiment of the present invention.
Figure 44:
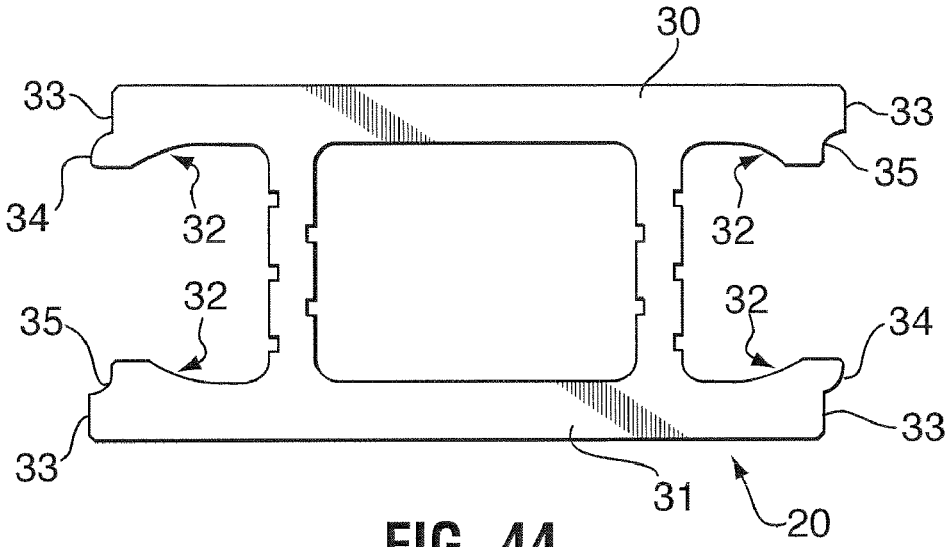
FIG. 44 is a top view of a stretcher block of the second embodiment of the present invention.
Figure 45:
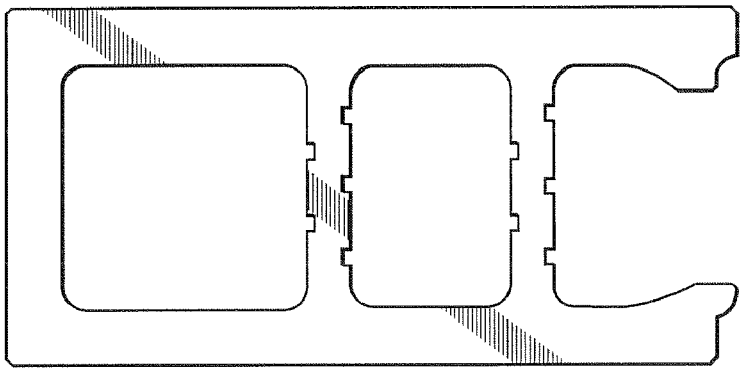
FIG. 45 is a top view of a sash block of the second embodiment of the present invention.
Figure 46:
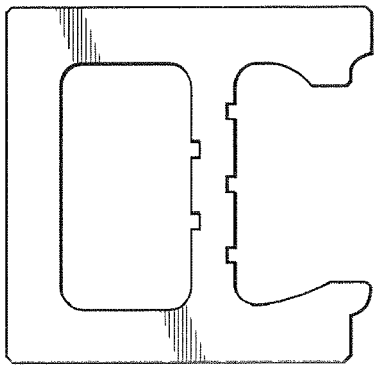
FIG. 46 is a top view of a half sash block of the second embodiment of the present invention.
Figure 47:
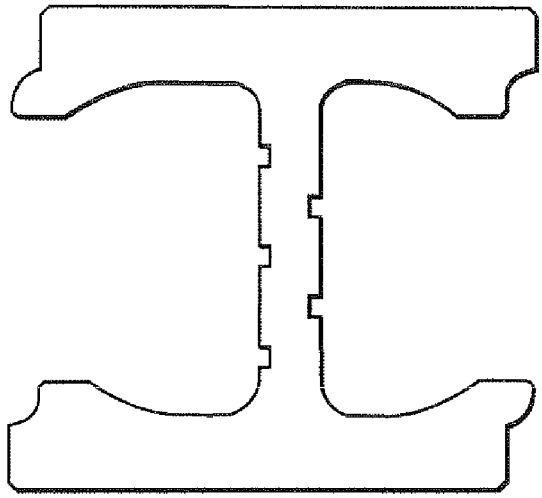
FIG. 47 is a top view of a half stretcher block of the second embodiment of the present invention.

In the alternate embodiment of the block of the present invention, as illustrated in FIG. 43, from the end perspective, the block 20 is substantially the same as that illustrated in FIGS. 1 to 42. The upper surface 21 of the block has a raised central portion 22 profiled to interfit with a channel 24 formed in the lower surface 25 of the block. The profile of the upper surface 21 is defined by a flat raised portion 22 that is about ¼ inch to 1 inch high, flanked by flat portion 26 about ½ to 1½ inches wide. Similar flat foot portions 27 are formed in the lowermost surface of the block.

The webs 28 of the block have semi-circular cut-outs 29 formed therein, for re-bar placement and to facilitate concrete flow.

Referring to FIGS. 44 to 49, wherein the various component blocks of the second embodiment are illustrated, it will be observed that each block has front 30 and rear 31 surfaces which terminate in laterally enlarged ends 32. Each end 32 of a front or rear panel has a laterally facing flat portion 33 adjacent the front or rear surface, and a vertically extending convex 34, or concave 35, interfit element on its inner edge. It will be observed that the overall length of the front 30 and rear 31 panels is identical. At each end, however, the flat portion 33 adjacent the concave interfit element will be aligned with the outer edge of the convex interfit element 34 on the opposite front, or rear panel. Therefore, when the blocks are laid in a course, the course will run straight. It will also be observed, in this regard, that each front panel 30 has a concave element 35 at one end, and a convex element 34 at the other end, as does each rear panel 31, but with the concave 35 and convex 34 elements reversed in position.

Figure 50:
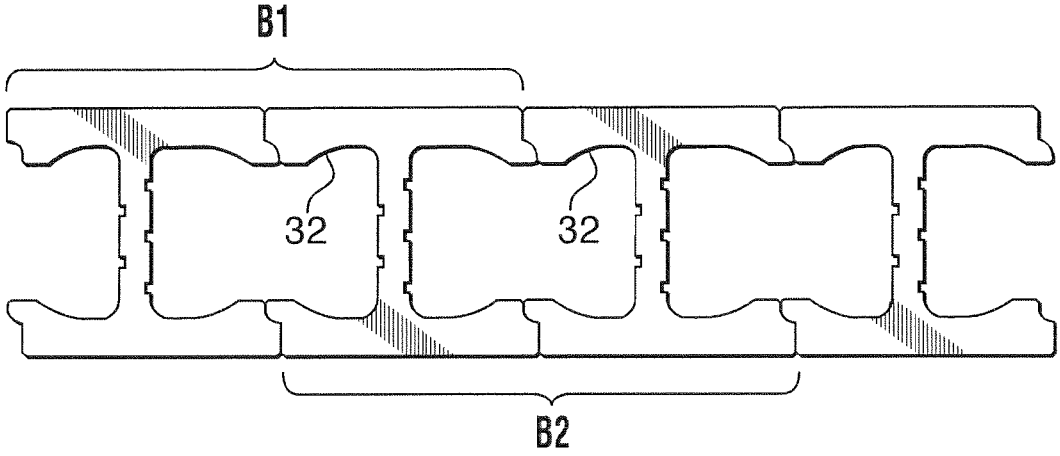
FIG. 50 is a plan view of two courses of blocks according to the second embodiment of the present invention.

The enlarged portions 32 at each end of the front and rear panels provide enhanced stability and strength of the completed walls. As can be seen in FIG. 50, when a first course of blocks including for exemplary purposes a block B1 has a second course of blocks including a block B2 laid on top of it, the ends of the blocks are staggered so that the end of block B1 is located below the hollow central core of block B2. Enlarged portion 32 of block B1 will not therefore be aligned with the inner wall of block B2. This will be the case for all blocks in all courses. When the hollow cores of the blocks are filled with concrete, then, the enlarged portions 32 will act as mechanical anchors in the concrete as it sets, to provide enhanced strength to the wall when the concrete hardens. The enlarged portions 32 also ensure that even if the bond between the blocks and poured concrete should fail for any reason, adjacent blocks, either vertically or horizontally adjacent, could not pull apart.

Figure 48:
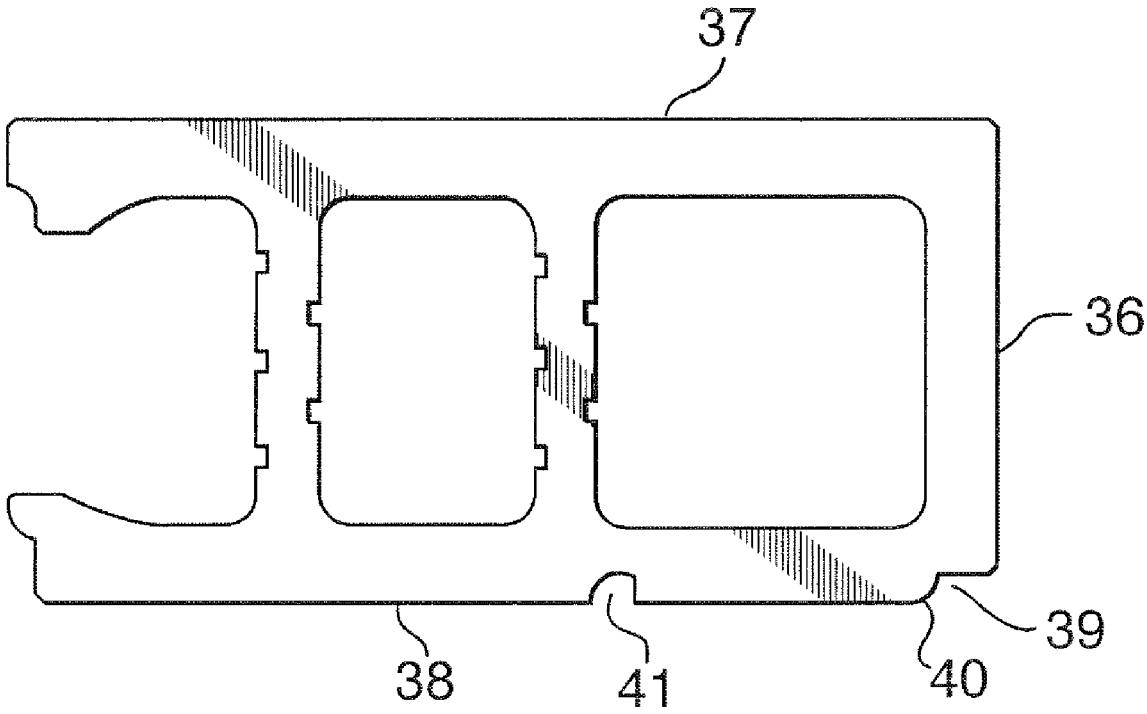
FIG. 48 is a top view of a right corner block of the second embodiment of the present invention.
Figure 49:
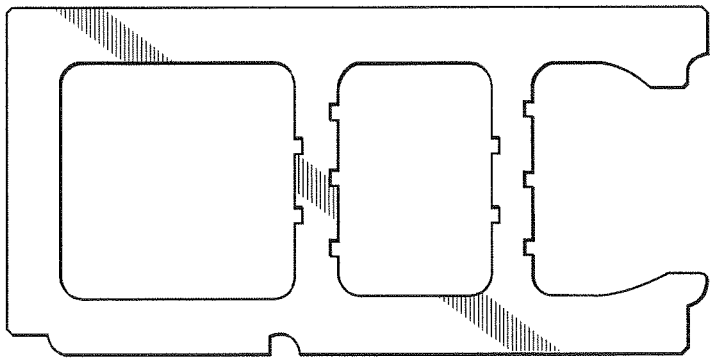
FIG. 49 is a top view of a left corner block of the second embodiment of the present invention.

Corner blocks of the alternate embodiment of the invention, as shown in FIG. 48, have a flat end 36 that together with the front face 37 of the block, will define the corner of a wall being constructed. On the rear face 38, notch 39 with a convex inside edge 40 and a concave groove 41 are formed convex edge 40 and concave groove 41 are spaced apart by a distance corresponding to the spacing between convex 34 and concave 35 interfit elements at the end of the front and rear panels of stretcher block 20. Accordingly, a stretcher block can be abutted against the rear face of the corner block, with interfit elements 34 and 35 accommodated by concave groove 41 and convex edge 40 respectively.

The raised portion 22 on the top surface of the corner block of the second embodiment, directly above groove 41 and notch 39 with edge 40 is channeled to accept the foot portion 27 of a block laid on it perpendicularly. It will be noted that foot portion 27 may be found under flat ends 36 of the corner blocks, and in that case, appropriate corresponding channels will be formed in the upper surface to accommodate same.

What is claimed is:

1. A construction block for use in constructing walls, said block including a front panel, a rear panel, and at least one web connecting said front and rear panels, each of said front and rear panels being rectangular and having a top edge surface, a bottom edge surface, and right and left edge surfaces, said at least one web having top and bottom surfaces co-extensive with the top and bottom surfaces of said front and rear panels thereby to define a top surface of said block, and a bottom surface of said block, said top surface of said block being provided with a shallow rectangular ridge along its length, flanked by longitudinally extending outer support surfaces, the lower surface of said block having a shallow rectangular channel formed therein along its length, flanked by longitudinally extending flat outer foot portions corresponding in width to said outer support surfaces; the right and left edge surfaces of said front and rear panels being thickened toward the interior of said block at their right and left ends and being profiled to interfit with one another, the right front edge surface and the left rear edge surface each having a first profile, and the left front edge surface and the right rear edge surface each have a second profile, the first and second profiles being complementary to permit blocks to interfit end to end, wherein said first profiles are defined by concave vertical grooves formed on diagonally opposed inner corners of a right or left edge surface of said front and rear panels, and said second profiles are convex vertical ridges formed on diagonally opposed inner corners of said right or left edge surface of said front and rear panels, wherein the front and rear panels are thickened at locations spaced from the web.

2. A block as claimed in claim 1, wherein two said webs are provided, with a generally rectangular hollow core formed between them.

3. A block as claimed in claim 2, wherein the upper surface of said webs is provided with a channel therein.

4. A block as claimed in claim 3, wherein the channel in the upper surface of said web is large enough to accommodate reinforcing materials.

5. A block as claimed in claim 1, wherein the concave vertical grooves and the convex vertical ridges are arcuate when viewed from above.

6. A block as claimed in claim 1, wherein the from and rear panels each define a maximum thickness at locations spaced from the web and from the respective first and second profiles.

* * * * *